US008967916B2

(12) United States Patent
Hussey et al.

(10) Patent No.: US 8,967,916 B2
(45) Date of Patent: Mar. 3, 2015

(54) MINE ROOF SUPPORT APPARATUS AND SYSTEM

(75) Inventors: David A. Hussey, Glenwood Springs, CO (US); Brian Czartorski, Muse, PA (US)

(73) Assignee: Earth Support Services, Inc., Glenwood Springs, CO (US)

( * ) Notice: Subject to any disclaimer, the term of this patent is extended or adjusted under 35 U.S.C. 154(b) by 0 days.

(21) Appl. No.: 13/465,540

(22) Filed: May 7, 2012

(65) Prior Publication Data

US 2012/0282039 A1 Nov. 8, 2012

Related U.S. Application Data

(60) Provisional application No. 61/482,851, filed on May 5, 2011.

(51) Int. Cl.

| | |
|---|---|
| ***E21D 20/00*** | (2006.01) |
| ***E21D 21/00*** | (2006.01) |
| ***E21D 20/02*** | (2006.01) |

(52) U.S. Cl.

CPC ..... *E21D 21/0046* (2013.01); *E21D 20/028* (2013.01); *E21D 21/008* (2013.01); *E21D 2021/006* (2013.01)

USPC ..... 405/259.5; 405/259.1; 405/259.3

(58) Field of Classification Search

USPC ..... 405/259.1, 259.3, 259.5, 266

See application file for complete search history.

(56) References Cited

U.S. PATENT DOCUMENTS

| | | | | |
|---|---|---|---|---|
| 4,601,614 | A * | 7/1986 | Lane et al. | 405/259.6 |
| 6,612,783 | B2 | 9/2003 | Stankus et al. | |
| 7,296,950 | B1 * | 11/2007 | Stankus et al. | 405/259.6 |
| 8,757,934 | B2 | 6/2014 | Hall et al. | |
| 2006/0093438 | A1 * | 5/2006 | Fergusson | 405/259.3 |
| 2009/0041550 | A1 * | 2/2009 | Oldsen et al. | 405/259.3 |
| 2011/0070035 | A1 * | 3/2011 | Ricardo | 405/259.5 |
| 2011/0217126 | A1 * | 9/2011 | Oldsen et al. | 405/259.4 |

* cited by examiner

*Primary Examiner* — Thomas B Will
*Assistant Examiner* — Katherine Chu
(74) *Attorney, Agent, or Firm* — McNees Wallace & Nurick LLC

(57) ABSTRACT

A cable bolt includes a multi-strand cable segment constructed from steel wire strands, and a drive head. A compressible porous backer rod is placed along cable segment adjacent the drive head. A tubing portion provides a conduit for liquid grout injected under pressure into the bore hole. Tubing portion includes discharge holes that may be predrilled through the wall of the tubing portion. The holes provide a predetermined distribution path for the liquefied grout that is injected into the bore hole. Discharge holes may be evenly dispersed longitudinally along the wall, or distributed to provide a desired, unequal distribution of grout. Distribution holes may be larger at the top of the tubing, or may be distributed adjacent to the top of tubing portion to allow greater cross-sectional flow of grout from the tubing to compensate for factors that restrict grout flow nearer the top.

15 Claims, 4 Drawing Sheets

MINE ROOF SUPPORT APPARATUS AND SYSTEM

CROSS-REFERENCE TO RELATED APPLICATIONS

This application claims the benefit of U.S. Provisional Application No. 61/482,851, entitled "Mine Roof Support Apparatus and System," filed May 5, 2011, which application is hereby incorporated by reference in its entirety.

FIELD OF THE INVENTION

The present invention is directed to a roof support system, and more particularly to a mine cable roof bolt system with a cable portion and a perforated grout tube for distributing grout in a cable bore hole.

BACKGROUND OF THE INVENTION

Cable systems and cable-type roof bolts have been used in the mining industry to reinforce the mine roof and prevent its collapse. Cable systems generally include a shank formed of a multi-strand cable and a barrel and wedge assembly secured to the cable to provide the necessary support after tensioning or support the bearing plate of the mine roof bolt assembly. The barrel and wedge assembly includes a tubular barrel with a plurality of locking wedges positioned within the barrel surrounding the cable securing the barrel and wedge assembly to the cable.

Cable mine roof bolts have been utilized in resin grouted applications. In resin grouted applications, the mine roof bolt is rotated to mix the resin during installation. Examples of cable mine roof bolts designed for resin grouted applications can be found in U.S. Pat. Nos. 5,230,589; 5,219,703 and 5,375,946.

To further support the mine roof a steel cable may be connect to the mining bolts to support the rock between the bolting sites. Various types of cabling systems have been introduced. One example is a cable bolting system that consists of a cable which is positioned into a bore hole. Bonding material is then pumped in under pressure around the cable to secure it to the rock. The bonding material must be pumped externally in a separate step after the cable is within the bore hole. The bonding material must completely fill the bore hole in order to ensure proper contact between the rock and the cable.

A further design for a cable-type mining support is made by Arnall, Inc. Arnall manufactures a stranded cable a length of which has an open-weave arrangement. (i.e., the strands are not tightly wound). This allows a bonding agent of cementatious grout, which is pumped into a bore hole, to penetrate into and integrate with the cable.

The pumping of viscous liquid grout presents challenges that are not easily resolved by the prior art grouted cable mine roof bolts. For example, the grouts used for reinforcing cable type roof bolts are generally fast-setting grouts, which can begin to block flow of grout in the roof bore hole shortly after being injected into the bore hole. In addition, lateral cracks or capillaries in the mine roof adjacent the lower rock strata may divert the pressurized fluidized grout away from the upper column of the cable bore hole, leaving a gap between the lower grouted column and the anchored wedge portion of the mine roof bolt. In many applications, the pressurization of the grout into the cable bore hole is all that is available for controlling the penetration of the grout, particularly to the upper portions of the annular column in which the cable is suspended.

What is needed is a method for distributing fluidized grout upwards in a vertical column that allows control of the fluid grout penetration into the full vertical column.

SUMMARY OF THE INVENTION

In one embodiment is a cable bolt apparatus for supporting a mine roof. The cable bolt apparatus includes a mechanical anchor configured to be driven into a closed end of a bore hole in a rock material. The mechanical anchor is expandable to fix the cable bolt in place in the bore hole. A flexible multi-stranded cable segment is connected at a first end to the mechanical anchor and at a second end to a drive head. A plate disposed adjacent the drive head. The drive head is rotatable to apply torque against the plate for tensioning the cable segment in the bore hole. A seal portion is disposed around the cable segment within the bore hole. A conduit extends into the bore hole for injecting a liquid grout material. At least one mixing element is configured to mix the liquid grout material within the bore hole. The conduit provides a predetermined distribution of the liquid grout material in the bore hole and the seal maintains the liquid grout material within the bore hole while the grout material solidifies and bonds with the rock material.

In another embodiment there is disclosed a method for installing a mine cable roof bolt in an underground mine roof for supporting the roof. The method includes the steps of a) drilling a bore hole in a mine roof; b) determining a length of a perforated tubing portion and selecting a perforation pattern for the tubing portion suitable for a predetermined distribution of grout; c) providing an elongated cable bolt and the perforated tubing portion; d) securing the perforated tubing portion to the elongated cable bolt; e) inserting the cable bolt and the perforated tubing portion into the bore hole; f) injecting liquid grout into the tubing portion under pressure; g) anchoring the cable in a closed end of the bore hole via an anchor portion; and h) mixing the resin to form an integrated mechanical anchor between the anchor portion and the resin with the mine roof rock adjacent the bore hole.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
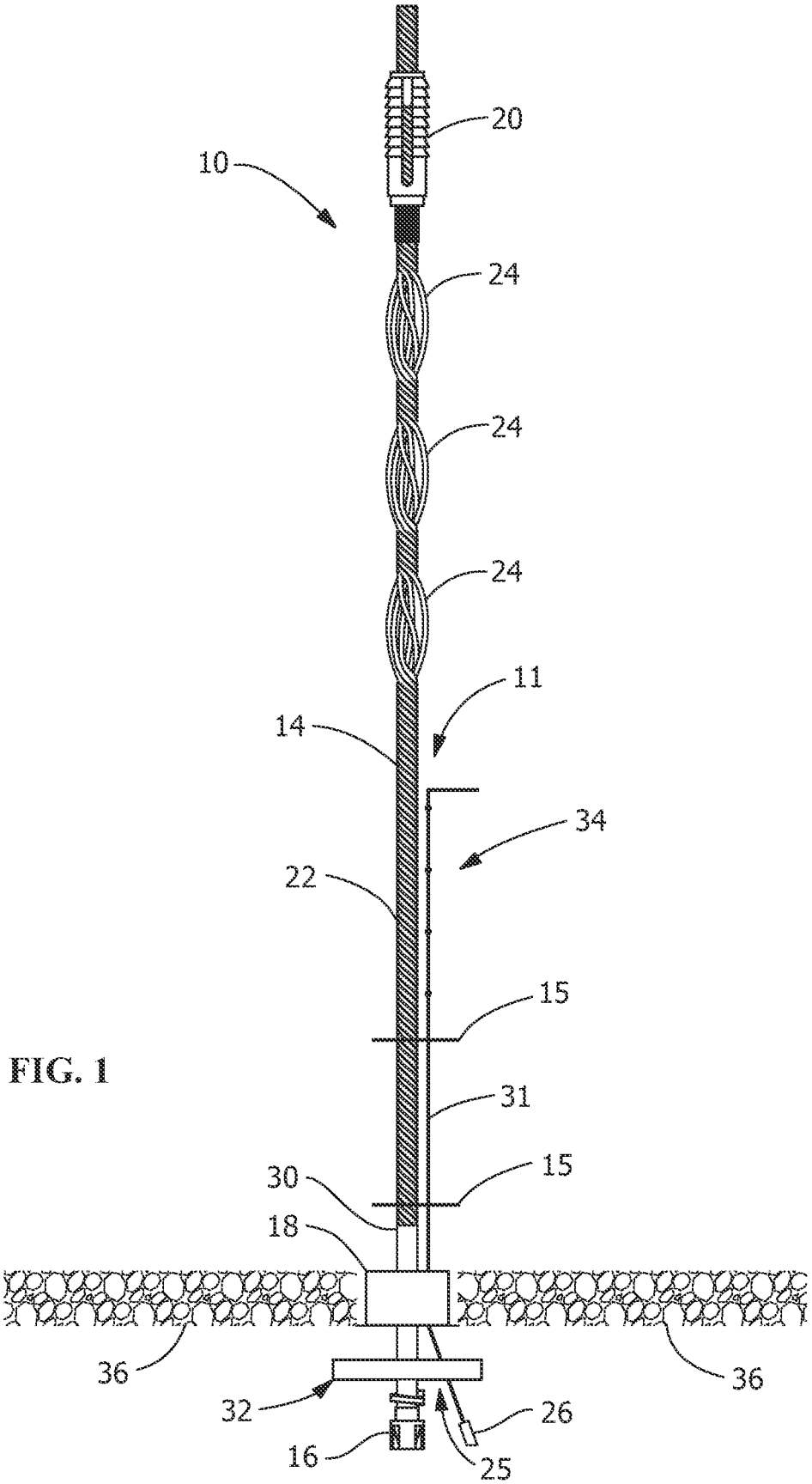
FIG. 1 shows an exemplary embodiment of a mine cable roof bolt.

Referring to FIG. 1, a stranded metal cable bolt 10 is shown. Cable bolt 10 includes a cable segment 14. In one embodiment cable segment 14 may be a multi-strand cable segment constructed from steel wire strands, wire made from steel alloys, or other suitable wire material. Cable segment 14 includes a drive head 16 integrally formed or attached to one end of cable segment 14. A backer rod 18 made from a compressed rope-like cellular foam is placed along cable segment 14 adjacent drive head 16. A roof bolt plate 32 is positioned between drive head 16 and backer rod 18. Backer rod 18 is compressible between roof bolt plate 32 and the mine roof surface 36 when drive head 16 is drawn up against roof bolt plate 32 during the installation process. Backer rod 18 is porous to absorb the polyurethane grout, and seal a bore hole 22 in the mine roof in which cable bolt 10 is inserted. As used herein, grout and resin both refer to polyurethane grouts, epoxy resin grouts, chemical grouts, and injection resin grouts, and similar resin/grout compounds that are well known to persons skilled in the art.

Polyurethane grout or other similar compounds are injected into bore hole 22 during the cable bolt installation process. A conduit or tubing portion 11 is affixed to cable segment 14 coaxially along a length of cable segment 14. Tubing portion 11 may be affixed to cable segment 14 using conventional cable ties 15, or alternately, using ratchet ties, straps or other suitable binding material. Cable ties 15 retain tubing portion 11 in position adjacent cable segment 14 when cable bolt 10 is inserted into bore hole 22.

Tubing portion 11 provides a conduit for liquid grout that is injected under pressure into bore hole 22. Tubing portion 11 includes discharge holes 34 that may be predrilled through the wall 31 of tubing portion 11. Discharges holes 34 provide a predetermined distribution path for the liquefied grout that is injected into bore hole 22 after cable bolt 10 is set in the closed end of bore hole 22. Discharge holes 34 may be evenly dispersed longitudinally along wall 31. Alternately, discharge holes may be distributed along wall according to a predetermined arrangement to provide a desired distribution of grout. In one exemplary embodiment, distribution holes 34 may be larger at the top of the tubing than at the bottom. Similarly, tubing portion 11 may have more distribution holes 34 adjacent to the top of tubing portion 11 than at the bottom, thereby allowing greater cross-sectional flow of grout from tubing portion 11 at the top than at the bottom, to compensate for factors that restrict grout flow nearer the top of bore hole 22. E.g., gravitational force, setting time, roof cracks or capillaries. Cracks/capillaries may draw much of the liquid grout as the grout is injected into bore hole 22, thus depleting the amount of grout, if any, that is available to fill in the upper end of the bore hole 22 or column.

Tubing portion 11 may be, e.g., a ⅜ inch inside diameter hollow brake line tubing that is commercially available, or other suitable type of tubing. Tubing portion 11 may extend the entire length of cable segment 14, or a portion thereof. The length of tubing portion 11 may be adjusted or selected to suit roof conditions, to direct the flow of grout to areas where a greater concentration of grout may be desired in one section of bore hole 22 for improved roof support.

Tubing portion 11 includes an angled tubing segment 25 that extends below the roof surface 36 at a 45° angle to the tube portion 11 axis, through the roof bolt plate 32, and adjacent drive head 16. A swivel coupling 26, e.g., a JIC-type swivel coupling or other quick disconnect type hydraulic coupling, may be attached to angled tubing segment 25 to facilitate the grout injection application. Roof bolt plate 32 is pre-drilled with a slotted or extended hole that will allow drive head 16 to be rotatably threaded to apply torque against roof bolt plate 32 without interference from angled tubing segment 25.

A drive head 16 and a barrel and wedge assembly are disclosed in U.S. Pat. No. 5,829,922 to Calandra, Jr. et al. However, other drive heads 16 integrally formed with cable segment 14, or otherwise attached to cable segment 14 by welding, swaging, casting, or other suitable method are clearly contemplated for use in association with cable bolt 10.

Cable bolt 10 includes a mechanical anchor 20, e.g., a multiple prong shell and wedge combination, attached to cable segment 14 via an externally threaded sleeve 21 positioned on an exterior surface of cable segment 14 between the ends of cable segment 14. Anchor 20 is driven into the closed end of bore hole 20, wherein the shell portion is compressed against the wedge and expanded into the adjacent rock to fix cable bolt 10 in place.

Figure 3:
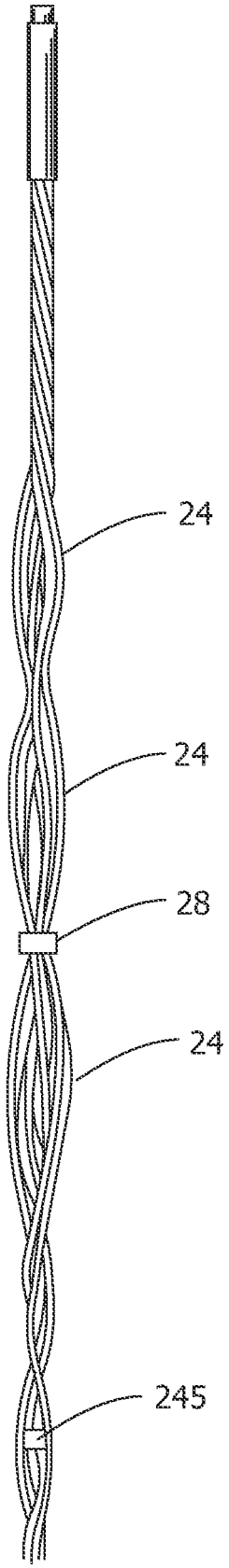
FIG. 3 shows a stranded wire cable segment with mixing elements disposed therein.

Referring to FIG. 3, a stranded wire cable segment is shown with mixing devices 24, 245, 28 disposed therein. Cable segment 14 of the tensionable cable bolt 10 may also include one or more resin mixing devices such as birdcages 24. Alternatively, nut cages 245, or button cages 28 may be used in place of, or in addition to, birdcages 24. A stiffening sleeve defining a hollow cavity configured to receive cable segment 14 may be positioned adjacent to the drive head 16.

Figure 4:
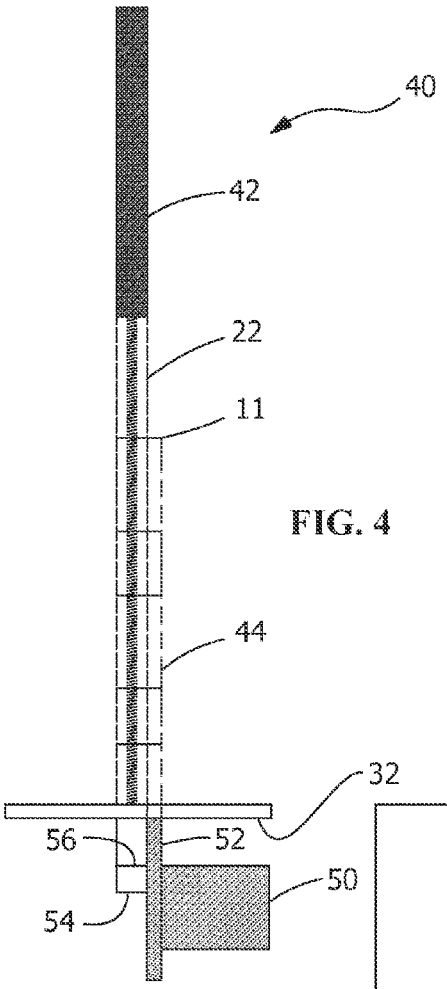
FIG. 4 shows another embodiment of a mine cable roof bolt.

Referring next to FIG. 4, in an alternate embodiment, a cable bolt 40 includes a resin tube portion 42 disposed in the top of the bore hole 22 for receiving resin and cable segment 14. Tubing portion 11 is affixed to cable segment 14 coaxially along a length of cable segment 14 as described above with respect to FIG. 1. Tubing portion 11 is provided with one or more internal mixing elements 50 (see FIG. 5) for mixing and injecting resin into bore hole 22. Mixing elements 50 allow the resin to mix at the point of entry of the tube portion 11, thus eliminating the need for an external mixing device, e.g., a mixer-packer, as is conventionally used when installing resin bolts. In one exemplary embodiment cable bolt 40 may have three mixing elements 50 per cable bolt 40, although more or less mixing elements 50 may be used if desired, to accommodate special field conditions. In one embodiment, mixing elements 50 may be used in combination with one or more mixing devices 24, 245, 28.

An insulation tubing 44 surrounds the bottom section of cable segment 14, adjacent roof bolt plate 32. Insulation tubing 44 maintains the polyurethane grout mix in bore hole 22 until the polyurethane grout mix sets. In one exemplary embodiment insulation tubing may be a closed cell pipe tubing insulation having an inside diameter of about 1-⅛", and about 9" in length, by way of example and not limitation. Other dimensions for inside diameter and length may be used as suited to the specific dimensions of cable bolt 40.

Mixing elements 50 are disposed on the opposite side of roof bolt plate 32 from bore hole 22. Mixing elements 50 are in fluid communication with tubing portion 11 through conduits 52, 54 and 56, and supply a fluid mixture of polyurethane grout or other resin mixture to the interior of tubing portion 11.

Figure 5:
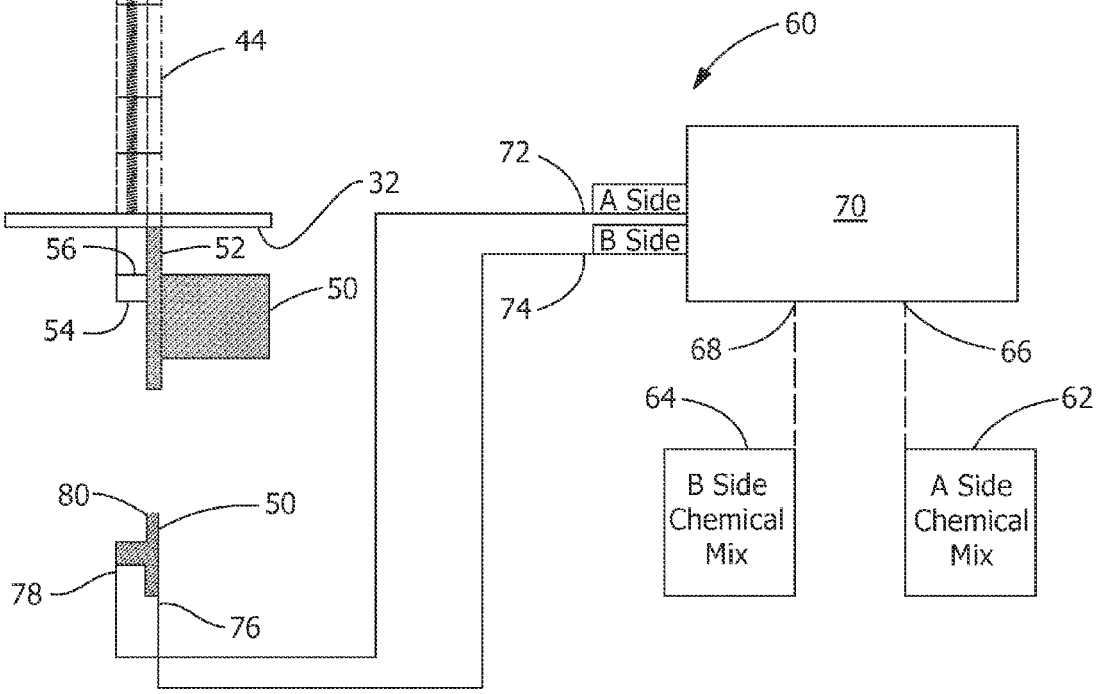
FIG. 5 shows a mixing element for grout and associated pump arrangement.

As shown in FIG. 5, a fluid circuit 60 is shown for mixing the chemicals that form the polyurethane grout mix. A first tank 62 containing a first chemical mix and a second tank 64 containing a second chemical mix are each connected to input ports 66, 68, respectively, of a pump 70. In one embodiment piston pump 70 may be, e.g., a double action piston pump powered pneumatically or hydraulically. First output port 72 of pump 70 is connected to a first inlet 76 of mixing element 50. Second output port 74 of pump 70 is connected to a second inlet 76 of mixing element 50. Mixing element 50 may be, e.g., a ½" tee fitting. An outlet port 80 of mixing element 50 supplies a fluid mixture of first and second chemicals to tubing portion 11, allowing the chemicals to be mixed adjacent to the point at which the mixture enters the tubing portion.

Figure 2:
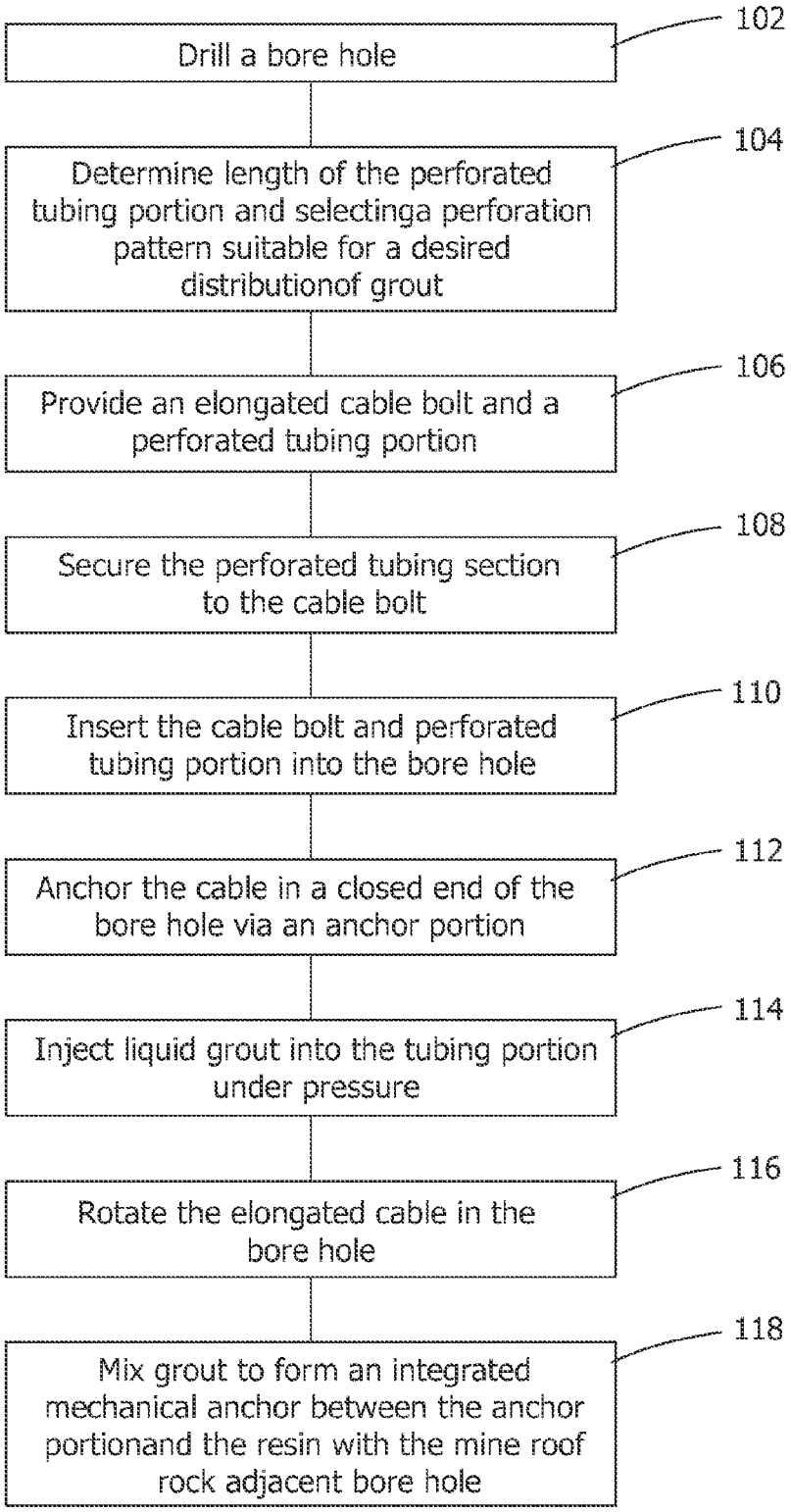
FIG. 2 shows one exemplary embodiment of a method for installing a mine cable roof bolt.

Also disclosed is a method of installing a mine cable roof bolt 10 in a mine roof for supporting the roof. Referring to FIG. 2, method 100 generally includes drilling a bore hole in a mine roof at step 102. Next, at step 104, the length of a perforated tubing portion is determined and a perforation pattern suitable for a desired distribution of grout is applied to the tubing portion. At step 106, an elongated cable bolt and the perforated tubing portion are provided, and at step 108, the perforated tubing section is secured to the elongated cable bolt. Next at step 110, the cable bolt and the perforated tubing portion are inserted into the bore hole using resin tube cartridges. At step 112 the cable is anchored in the closed end of the bore hole via an anchor portion, i.e., expansion shell located on an end of the cable or resin, or a combination of both. At step 114, liquid grout is injected under pressure into the perforated tubing section. The method then proceeds at step 116 to rotating the elongated cable in the bore hole. Next at step 118, a grout or resin is mixed in the bore hole, e.g., by attaching a quick disconnect or similar fitting and pumping grout mix through the fitting, to form an integrated mechanical anchor between the anchor portion and the resin with the mine roof rock adjacent the bore hole.

Additional steps of the method may include installing a backer rod around an intermediate portion of the cable roof bolt and tubing portion to seal an entrance of the bore hole at the surface of the mine roof; drawing a roof bolt plate up against the mine roof to compress the backer rod; and drilling a slotted or elongated hole in the roof bolt plate to accommodate an angled stub portion of the tubing portion.

In one alternate embodiment, a hollow core rebar-type bolt may be substituted for the cable bolt, and the hollow core used as distribution path for the grout. The hollow rebar bolt may be perforated selectively for customizing the grout distribution for the roof support application. In another embodiment, hollow fiberglass rib bolts, with or without perforations may be used in place of the cable bolt.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A cable bolt apparatus for supporting a mine roof comprising:

a mechanical anchor configured to be driven into a closed end of a bore hole in a rock material, the mechanical anchor expandable to fix the cable bolt in place;

a flexible multi-stranded cable segment connected at a first end to the mechanical anchor and at a second end to a drive head;

a plate disposed adjacent the drive head, the drive head rotatable to apply torque against the plate for tensioning the cable segment in the bore hole;

a seal portion disposed around the cable segment within the bore hole;

a conduit extending through the plate and into the bore hole for injecting a liquid grout material;

the conduit comprising a plurality of discharge holes through a wall of the conduit to provide a path to distribute the liquid grout material that is injected into the bore hole; and at least one mixing element configured to mix the liquid grout material at a point of entry of the conduit;

wherein the conduit is disposed adjacent to the flexible multi-stranded cable segment, the conduit and the flexible multi-stranded cable being nonconcentric; and wherein the plurality of discharge holes are distributed along the conduit wall within the bore hole; and wherein the conduit provides a predetermined distribution of the liquid grout material in the bore hole and the seal maintains the liquid grout material within the bore hole while the grout material solidifies and bonds with the rock material.

2. The apparatus of claim 1, wherein the conduit is affixed to the cable segment along at least a portion of the cable segment.

3. The apparatus of claim 1, wherein the discharge holes are evenly dispersed longitudinally along the wall of the conduit.

4. The apparatus of claim 1, wherein the discharge holes are configured to provide an unequal distribution of grout.

5. The apparatus of claim 1, wherein the discharge holes are arranged to allow greater cross-sectional flow of grout from the conduit to compensate for factors restricting grout flow nearer the closed end of the bore hole.

6. The apparatus of claim 1, wherein the cable segment includes at least one grout mixing device.

7. The apparatus of claim 6, wherein the at least one grout mixing device is one of a birdcage, a nut cage, or a button cage.

8. The apparatus of claim 1, wherein the drive head is threaded onto the cable bolt for rotatably torquing the plate.

9. The apparatus of claim 1, further comprising a stiffening sleeve defining a hollow cavity configured to receive cable segment positioned adjacent to the drive head.

10. The apparatus of claim 1, wherein the seal portion is compressible between the plate and a surface surrounding an entrance to the bore hole when the drive head is tensioned against the plate.

11. The apparatus of claim 1, wherein the conduit further comprises an angled tubing segment extending below the roof surface at an angle to the conduit through the roof bolt plate and drive head.

12. The apparatus of claim 11, wherein the plate further comprises a slotted aperture to allow the angled tubing to pass through the plate, and the drive head to be rotatably threaded against roof bolt plate without interference from the angled tubing segment.

13. The apparatus of claim 1, wherein the mixing element comprises a tee fitting configured with a first port in fluid communication with a pump for receiving a first chemical compound, a second port in fluid communication with the pump for receiving a second chemical compound, and a third port for discharging a combination of the first chemical compound and the second chemical compound, wherein the first chemical compound and the second chemical compound form the liquid grout material.

14. The apparatus of claim 13, wherein the pump comprises a double action pump, the double action pump configured with a first side for pumping the first chemical compound and a second side for pumping the second chemical compound.

15. The apparatus of claim 11, further comprising a swivel coupling to detachably couple the angled tubing segment to the conduit.

* * * * *